US007258752B2

(12) United States Patent
Maziasz et al.

(10) Patent No.: US 7,258,752 B2
(45) Date of Patent: Aug. 21, 2007

(54) WROUGHT STAINLESS STEEL COMPOSITIONS HAVING ENGINEERED MICROSTRUCTURES FOR IMPROVED HEAT RESISTANCE

(75) Inventors: Philip J. Maziasz, Oak Ridge, TN (US); Robert W. Swindeman, Oak Ridge, TN (US); Bruce A. Pint, Knoxville, TN (US); Michael L. Santella, Knoxville, TN (US); Karren L. More, Knoxville, TN (US)

(73) Assignee: UT-Battelle LLC, Oak Ridge, TN (US)

( * ) Notice: Subject to any disclaimer, the term of this patent is extended or adjusted under 35 U.S.C. 154(b) by 126 days.

(21) Appl. No.: 10/397,582

(22) Filed: Mar. 26, 2003

(65) Prior Publication Data

US 2004/0191109 A1 Sep. 30, 2004

(51) Int. Cl.
*C22C 38/48* (2006.01)
*C22C 38/42* (2006.01)
*C22C 38/44* (2006.01)

(52) U.S. Cl. ..... 148/327; 148/326

(58) Field of Classification Search ..... 148/326, 148/327, 419, 442, 325; 420/45, 47, 584, 420/586.1, 53

See application file for complete search history.

(56) References Cited

U.S. PATENT DOCUMENTS 3,826,689 A * 7/1974 Ohta et al. ..... 148/540
4,329,173 A * 5/1982 Culling ..... 420/38
4,818,485 A * 4/1989 Maziasz et al. ..... 420/57
4,960,470 A * 10/1990 Honkura et al. ..... 148/608
5,292,384 A 3/1994 Klueh et al.
5,545,373 A 8/1996 Maziasz et al.
6,146,582 A * 11/2000 Linden ..... 420/40
6,171,547 B1 * 1/2001 Sagara et al. ..... 420/49
6,436,339 B1 8/2002 Maziasz et al.
6,485,679 B1 * 11/2002 Sundstrom et al. ..... 420/38
7,153,373 B2 * 12/2006 Maziasz et al. ..... 148/327

OTHER PUBLICATIONS

Maziasz et al., "Improving High-Temperature Performance of Austenitic Stainless Steels for Advanced Microturbine Recuperators", Parsons 2003: Engineering Issues in Turbine Machinery, Power Plants and Renewables, The instiitue for Materials, Minerals and Mining, Maney Publishing London UK.*

J. Barford, "Kinetics of NbC preciptiation in austenite", Journal of The iron and Steel Institute, Feb. 1955.*

U.S. Appl. No. 10/323,194, filed Dec. 18, 2002, Klueh et al.

(Continued)

*Primary Examiner*—Deborah Yee
(74) *Attorney, Agent, or Firm*—Akerman Senterfitt; Andrew C. Gust

(57) ABSTRACT

A wrought stainless steel alloy composition includes 12% to 25% Cr, 8% to 25% Ni, 0.05% to 1% Nb, 0.05% to 10% Mn, 0.02% to 0.15% C, 0.02% to 0.5% N, with the balance iron, the composition having the capability of developing an engineered microstructure at a temperature above 550° C. The engineered microstructure includes an austenite matrix having therein a dispersion of intragranular NbC precipitates in a concentration in the range of $10^{10}$ to $10^{17}$ precipitates per $cm^3$.

47 Claims, 5 Drawing Sheets

OTHER PUBLICATIONS

U.S. Appl. No. 10/195,703, filed Jul. 15, 2002, Maziasz et al.
U.S. Appl. No. 10/195,724, filed Jul. 15, 2002, Maziasz et al.
P.J.Maziasz et al, "Microstructural Stability & Control for Improved Irrradiation Resistance & for High-Temperature Strength of Austenitic SS's", ASTM-STP-979, Am.Soc. for Testing & Materials, (1988) p. 116-161.
P. J. Maziasz, "Developing an Austenitic Stainless Steel for Improved Performance in Advanced Fossil Power Facilities," Journal of Metals, V. 41, #7, Jul. 1989, p. 14-20.
R. W. Swindeman et al, "The Mechanical & Microstructural Stability of Austenitic SS's Strengthened by MC-Forming Elements," in Creep: Characterization, Damage and Life Assessments, ASM-International, Materials Park, OH (1992), p. 33-42.
P. J. Maziasz et al, "Selecting and Developing Advanced Alloys for Creep-Resistance for Microturbine Recuperator Applications," paper 2001-GT-541, Am. Soc.of Mechanical Engineers, New York, NY (Jun. 2001).
B. A. Pint et al, "Materials Selection for High Temperature (750-1000 C) Metallic Recuperators for Improved Efficiency Microturbines," paper 2001-GT-445, American Society of Mechanical Engineers, (Jun. 2001).
H. Teranishi et al, "Fine-Grained TP347H Steel Tubing with High Elevated-Temperature Strength & Corrosion Resistance for Boiler Applications," paper 38, Sumitomo Metal Industries, Lt., Osaka & Tokyo, Japan (May 1989).
R. W. Swindeman, "Stainless Steels with Improved Strength for Service at 760 C and Above," ASME International, PVP-vol. 374, Fatigue, Environmental Factors & New Materials, Book #H01155 (1998) pp. 291-298.
A. Iseda, "Advanced Heat Resistant Steels, Tubes & Pipe for Power Generation Boilers," KESTO-Technology Programs, Annual Seminar (1999).
T.Andersson et al, "Structure & Properties of a 19Cr-25Ni-Mo-Ti Steel," in MiCon 78, American Society for Testing & Materials, Philadelphia PA, (1979) p. 393-405.
R. A. Lula, "High Manganese Austenitic Steels, Present & Future," in Conf. Proc. High Manganese High Nitrogen Austenitic Steel, ASM-International, Materials Park OH (1992) p. 1-12.
W.Stasko et al, "New Automotive Valve Steels with Improved Properties," in Conf. Proc.High Manganese High Nitrogen Austenitic Steel, ASM-International, Materials Park OH (1992) p. 43-52.
V.Ramakrishnan et al, "The Effect of Manganese on the High Aluminum Low Chromium Content Austenitic SS Alloys," in Conf.Proc.High Manganese High Nitrogen Austenitic Steel, ASM-International, Materials Park, OH (1992) p. 89-109.

* cited by examiner

WROUGHT STAINLESS STEEL COMPOSITIONS HAVING ENGINEERED MICROSTRUCTURES FOR IMPROVED HEAT RESISTANCE

The United States Government has rights in this invention pursuant to contract no. DE-AC05-00OR22725 between the United States Department of Energy and UT-Battelle, LLC.

FIELD OF THE INVENTION

The present invention relates to wrought stainless steel compositions, and more particularly to thin-section (e.g., thin plate, sheet, foil, etc.) wrought stainless steels having small grains and engineered microstructures containing austenite having dispersions of at least one of intragranular NbC, intragranular Cu-rich clusters and/or precipitates, and/or Alumina scale.

BACKGROUND OF THE INVENTION

New, high-performance high-efficiency compact heat-exchangers are being developed for new distributed power or combined heat and power technologies, such as microturbines, polymer-exchange membrane fuel cells, Stirling engines, gas-cooled nuclear reactors, etc. These power technologies often require thin-section austenitic stainless steels. Currently, stainless steels of types 347, 321, 304, 316 are used, but are limited by their lack of both creep-rupture resistance and corrosion resistance at 700° C. and above, especially with alternate and/or opportunity fuels and more corrosive exhaust environments. Such stainless steels also lack aging resistance and can loose ductility at low temperatures after aging. Ductility is very important for crack resistance during rapid cycling or thermal shock applications.

For extremely aggressive corrosion environments (for example, alternate fuels containing sulfur and fuel-reforming to produce hydrogen for fuel cells that add carburization and/or dusting to corrosion attack mechanisms) at 800° C. or above, alloys capable of forming protective alumina scales would be even better than alloys that form chromia scales. While much more expensive Ni-based or Co-based alloys and superalloys do exist that could be used for such applications, they cost 5-10 times more than commercial Fe—Cr—Ni austenitic stainless steels, and they would make such energy technologies cost-prohibitive.

Various alloying elements have effects on the complex microstructures produced in austenitic stainless steels during processing and/or during high temperature aging and service. The effects include changes in properties at high temperatures, including tensile strength, creep strength, rupture resistance, fatigue and thermal fatigue resistance, oxidation and corrosion resistance, oxide scale formation, stability and effects on sub-scale metal, and resistance to aging-induced brittleness near room-temperature.

A particular problem for use of stainless steels and alloys in such applications is that the fine grain size (<20-50 μm diameter) required to make thin section articles, completely changes the relative behavior of many alloys and/or the beneficial/detrimental effects of various alloying elements compared to heavier sections (ie. rolled plate or wrought tubing) with much coarser grain size. Fine grain size dramatically reduces creep resistance and rupture life, and below some critical grain size (1-5 μm diameter, depending on the specific alloy) the alloy is generally superplastic and not creep resistant at all. Two examples are 347 and 347HFG (high-carbon, fine-grained) and 347 and 310 austenitic stainless steels. As thicker plate or tubing, 347 HFG has twice the strength of 347, but as foils (nominal 3-10 mil thickness) with similar processing, 347 has better creep-rupture resistance than 347 HFG. Similarly, 310NbN stainless steel is much stronger than 347 steel as plate or tubing and has higher allowable stresses in the ASME construction codes, but as similarly processed foils, the 347 has significantly better creep-rupture resistance.

Therefore, fine-grained, thin-section manufacturing can dramatically reverse the relative strengths of various alloys and alter the expected microstructure properties thereof.

OBJECTS OF THE INVENTION

Accordingly, objects of the present invention include the provision of new thin-section stainless steels compositions having engineered microstructures that exhibit improved heat and corrosion resistance in thin-section applications such as thin plate, sheet, foil, etc. Further and other objects of the present invention will become apparent from the description contained herein.

SUMMARY OF THE INVENTION

In accordance with one aspect of the present invention, the foregoing and other objects are achieved by a wrought stainless steel alloy composition that includes 12% to 25% Cr, 8% to 25% Ni, 0.05% to 1% Nb, 0.05% to 10% Mn, 0.02% to 0.15% C, 0.02% to 0.5% N, with the balance iron, the composition having the capability of developing an engineered microstructure at a temperature above 550° C. The engineered microstructure includes an austenite matrix having therein a dispersion of intragranular NbC precipitates in a concentration in the range of $10^{10}$ to $10^{17}$ precipitates per $cm^3$.

In accordance with another aspect of the present invention, a wrought stainless steel alloy composition includes 15% to 20% Cr, 8% to 13% Ni, 0.05% to 1% Nb, 1% to 5% Mn, 0.02% to 0.1% C, 0.02% to 0.3% N, with the balance iron. The composition has the capability of developing an engineered microstructure subsequent to fabrication into an article. The engineered microstructure includes an austenite matrix having therein a dispersion of intragranular NbC precipitates in a concentration in the range of $10^{10}$ to $10^{17}$ precipitates per $cm^3$.

In accordance with a further aspect of the present invention, a wrought stainless steel alloy composition includes 15% to 20% Cr, 8% to 13% Ni, 0.05% to 1% Nb, 1% to 5% Mn, 0.02% to 0.1% C, 0.02% to 0.3% N, up to 4% Cu with the balance iron. The composition has the capability of developing an engineered microstructure subsequent to fabrication into an article. The engineered microstructure includes an austenite matrix having therein a dispersion of intragranular NbC precipitates in a concentration in the range of $10^{10}$ to $10^{17}$ precipitates per $cm^3$, and intragranular copper-rich clusters and/or intragranular copper-rich precipitates.

In accordance with a still further aspect of the present invention, a wrought stainless steel alloy composition includes 19% to 25% Cr, 19% to 25% Ni, 0.05% to 0.7% Nb, 0.5% to 5% Mn, 0.02% to 0.1% C, no more than 0.05% N, up to 5% Al, with the balance iron. The composition has the capability of developing an engineered microstructure subsequent to fabrication into an article. The engineered microstructure includes an austenite matrix having therein a dispersion of intragranular NbC precipitates in a concentration in the range of $10^{10}$ to $10^{17}$ precipitates per $cm^3$, and alumina scale.

All of the above-described compositions are preferably resistant to the formation of embrittling intermetallic phases, chromium carbides, and chromium nitrides.

Figure 1:
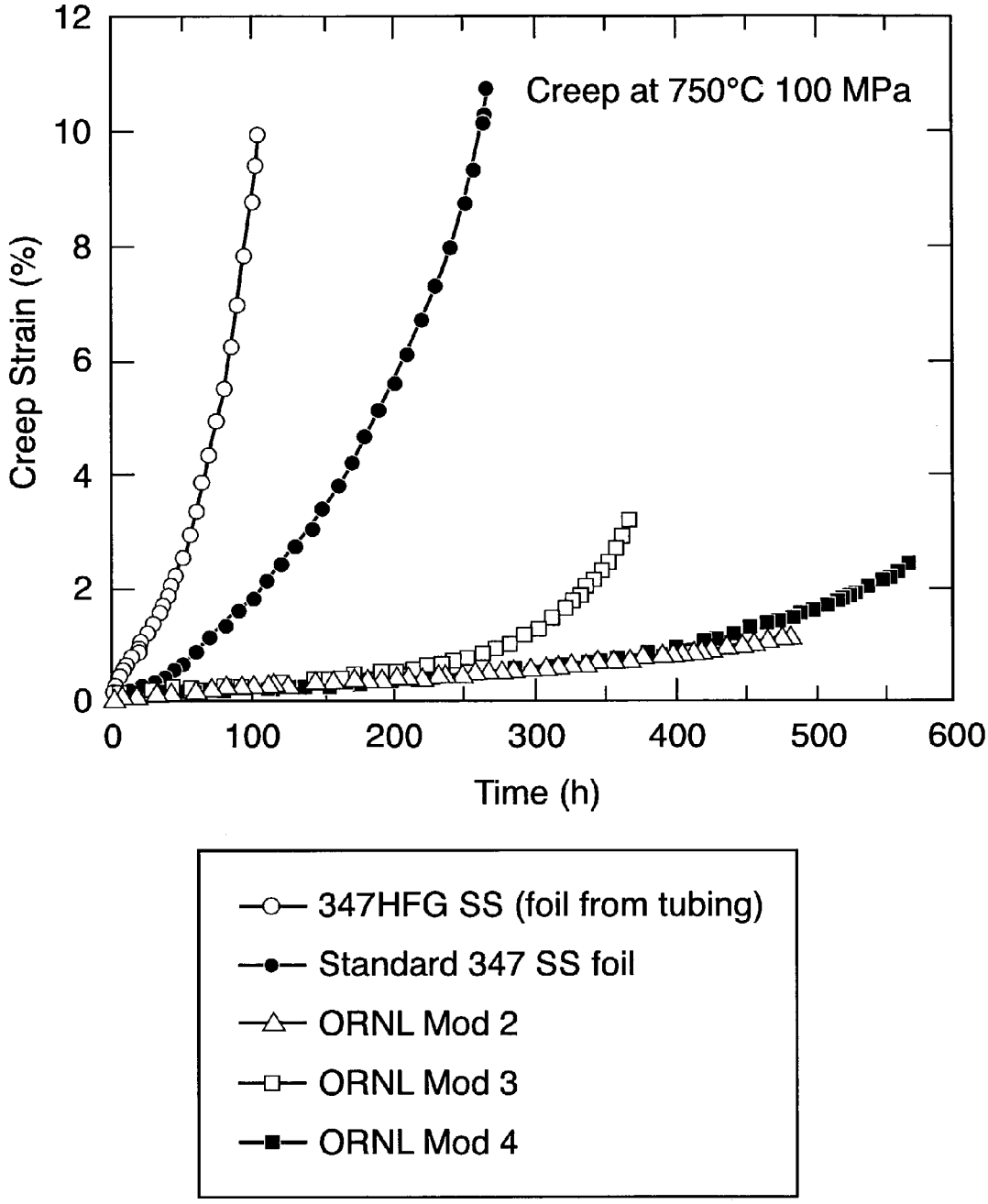
FIG. 1 is a plot of creep-strain versus time for modified laboratory heats of stainless steels in accordance with the present invention compared with conventional stainless steels.

For a better understanding of the present invention, together with other and further objects, advantages and capabilities thereof, reference is made to the following disclosure and appended claims in connection with the above-described drawings.

DETAILED DESCRIPTION OF THE INVENTION

The present invention arose from the application of unique empirical design rules developed to directly relate changes in alloy composition to changes in the microstructure that develops not during processing or at the time of fabrication of thin-section articles therefrom, but rather subsequently thereto. Engineered microstructures develop during early service, particularly, exposure of the thin-section stainless steel compositions of the present invention to high temperatures, for example, 550° C. to 950° C., and particularly above 650° C.

The unique design rules may include, but are not limited to:

1. direct reactant effects of elements added to the composition in order to form precipitates;
2. catalytic effects of elements added to the composition to enhance formation of phases formed by other elements;
3. inhibitor effects of elements added to the composition to impede or eliminate formation of phases formed by other elements; and
4. interference effects of various alloying elements on precipitation behavior at high temperatures.

Microstructure involves the morphology of a composition—the arrangement of constituents within a composition, and physical/chemical relationships thereof. Microstructure may include, but is not limited to: crystal structure of parent (matrix) and/or various precipitate phases; grain size; grain shape; grain boundaries; clusters; precipitates; dislocations. Clusters and precipitates include size, distribution, uniformity, and morphology.

Developing heat-resistant thin-section steel compositions necessarily involve at least one of two considerations—grain size and intragranular microstructure Grain size is controlled in accordance with the present invention in the following way: Solution-annealing on the penultimate annealing step followed by a final annealing step produces a grain size larger than the critical grain size on the final anneal. Gains that are smaller than the critical grain size result in a superplastic composition. In this process, grain size is brought to more feasible sizes in order to improve creep resistance.

Preferable grain sizes are dependent on specific composition and thickness of an article made therefrom. Thin-section articles of nominal thickness 0.005" to 0.015" will generally require processing that results in grains of sizes in the range of 15 μm to 50 μm, more preferably 15 μm to 30 μm, most preferably 15 μm to 20 μm. Metal foil (nominal thickness <0.005") will generally require processing that results in grain sizes in the range of 2 μm to 15 μm, more preferably 5 μm to 15 μm, most preferably 10 μm to 15 μm. These values are general and will vary with composition and specific thickness.

Engineered microstructures in accordance with the present invention contain minimal delta ferrite or martensite (ideally none), but comprise stable austenite grains. These grains exhibit minimal primary NbC precipitation in the as-cast initial structure, but rather are capable of precipitating new fine, stable dispersions of NbC within the grains and along grain boundaries upon high-temperature service exposure. The engineered microstructures also exhibit minimal precipitation of detrimental intermetallic phases (sigma, Laves, $M_6C$, chi) or chrome-carbides ($M_{23}C_6$) during aging or service at 600° C. to 950° C.

For thin-section applications, the new stainless steels and alloys of the present invention at the same time maintain good deformability and weldability to manufacture components, and contain sufficient chromium for good high-temperature oxidation and water-vapor corrosion resistance.

The present invention is based on several important concepts and unexpected discoveries:

1. Particular levels of manganese, copper and/or nitrogen can all be combined and used instead of nickel to stabilize (and strengthen) the austenite matrix against high-temperature intermetallic formation. They do not interfere with the precipitation of fine intragranular NbC precipitates needed for high-temperature strength. Moreover, NbN does not form. Also, Cu produces clusters and/or precipitates that enhance high-temperature strength.

2. Particular levels of manganese increase the long-term stability of fine NbC necessary for long-term creep strength.

3. The combination of manganese and nitrogen (and possibly copper), directly and/or indirectly, positively enhance the stability of chromium oxide scales during high-temperature oxidation with water vapor.

4. Combinations of the above synergistically produce a very stable austenite parent phase that has good weldability, with no evidence of hot- or cold-cracking.

Examples of the present invention are shown in FIG. 1. Compositions made according to the present invention are "modified" 347 stainless steels designated as ORNL Mod 2, ORNL Mod 3, and ORNL Mod 4. FIG. 1 is a plot of creep-strain versus time for these three new ORNL modified laboratory heats of type 347 stainless steel (17-18Cr, 10-13Ni, ORNL Mod 2 and Mod 4, and 20Cr-15Ni, ORNL mod 3) tested in air at 750° C. For comparison, foil from standard commercial 347 stainless steel, and from foil produced by splitting, flattening and rolling commercial 347H tubing (Sumitomo, H—high carbon, FG—fine grained), both with similar lab-scale foil processing, are also included.

FIG. 1 shows that with various combinations of manganese, nitrogen and/or copper, specimens of the invention exhibited unexpectedly and remarkably enhanced creep strength when compared to the best processing of standard, commercial 347 stainless steels, and even more remarkably so when compared to commercial microturbine recuperator 347 steel foils that last less than 100 h under the same creep conditions.

Figure 2:
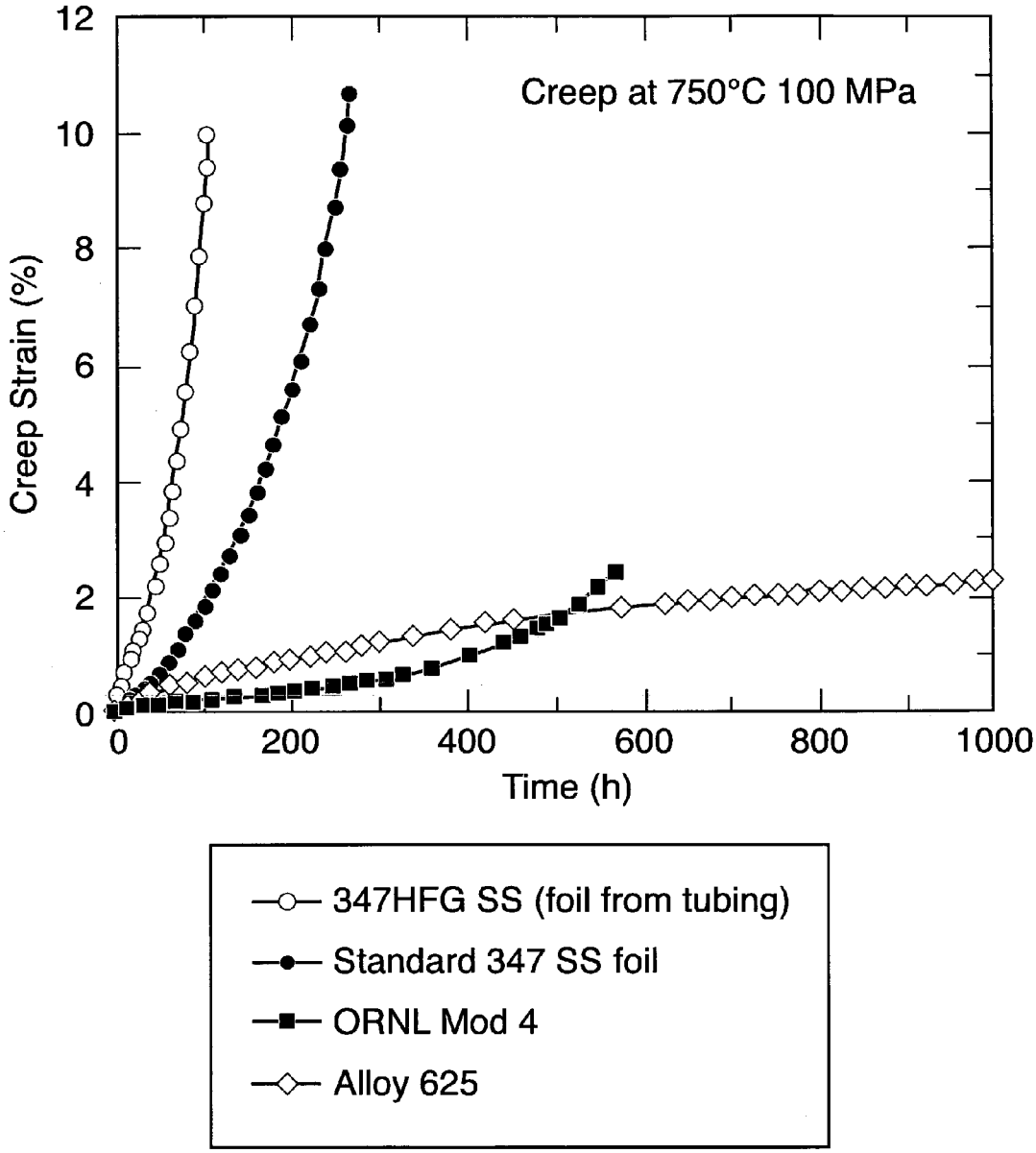
FIG. 2 is another plot of creep-strain versus time for a modified laboratory heat of a stainless steel in accordance with the present invention compared with conventional stainless steels.

Data in FIG. 2 shows creep-strain versus time for one of the new ORNL modified laboratory heats of type 347 stainless steel (ORNL Mod 4) and Ni-based superalloy 625 (Ni-22Cr-9Mo-3.6Nb-3.5Fe), both processed into foils at ORNL and tested in air at 750° C. ORNL Mod 4 shows creep resistance similar to alloy 625 prior to rupture. Standard commercial 347 stainless steels included for comparison are the same as mentioned above for FIG. 1.

Modified 347 stainless steels in accordance with the present invention are characterized by creep-resistance comparable to alloy 625, a nickel-based superalloy that is much more costly, as shown in FIG. 2. Since Mn, N, and Cu are much less costly than Ni, the new modified 347 steels of the present invention have dramatically improved cost-effective creep-resistance relative to more expensive Fe—Cr—Ni alloys.

Figure 3:
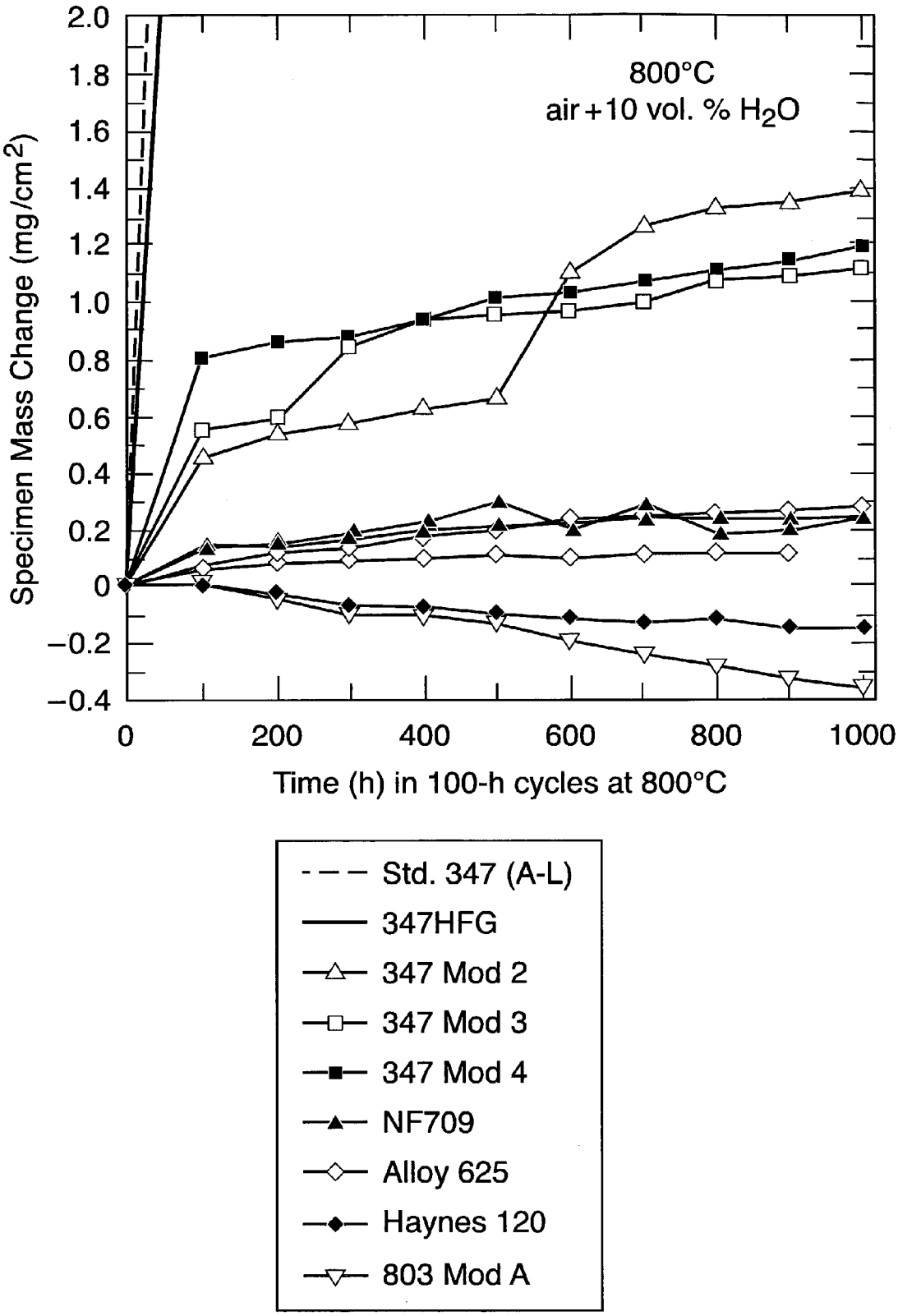
FIG. 3 is a plot of oxidation testing of foil coupons of modified laboratory heats of stainless steels in accordance with the present invention compared with conventional stainless steels.

The discovery that Mn and probably N also improve the high-temperature oxidation resistance, especially with water vapor, was unexpected based on conventional understanding and wisdom of alloying effects on oxidation/corrosion behavior, but is clearly demonstrated in FIG. 3, which illustrates oxidation testing of foil coupons in air+10% water vapor at 800° C., with cycling to room temperature every 100 h for weight measurements. Foils of commercial stainless steels (standard 347 and 347 HFG), stainless alloys (NF709, Haynes alloy 120 and modified alloy 803 (A)), and a Ni-based superalloy (alloy 625), and ORNL Mods 2, 3, and 4 were all lab-scale processed at ORNL, and are the same as those used to also make tensile/creep specimens. All foils were made from plate stock, except for 347 HFG and NF709, which were made from split and flattened boiler tubing. All foils were tested in the solution-annealed condition.

Figure 4A:
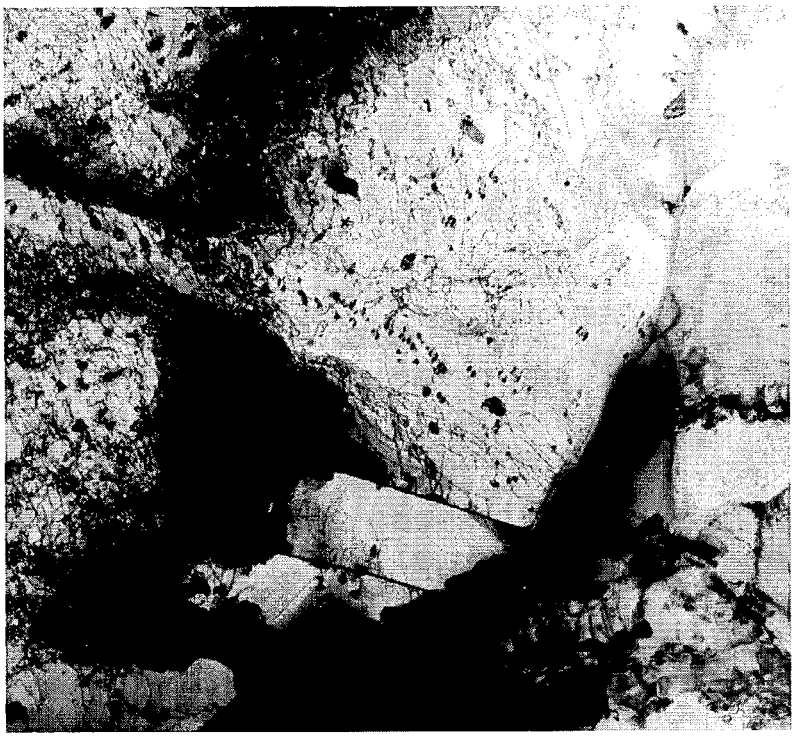
FIG. 4*a* is a photomicrograph showing the microstructure of a creep test specimen of 347 austenitic stainless steel.
Figure 4B:
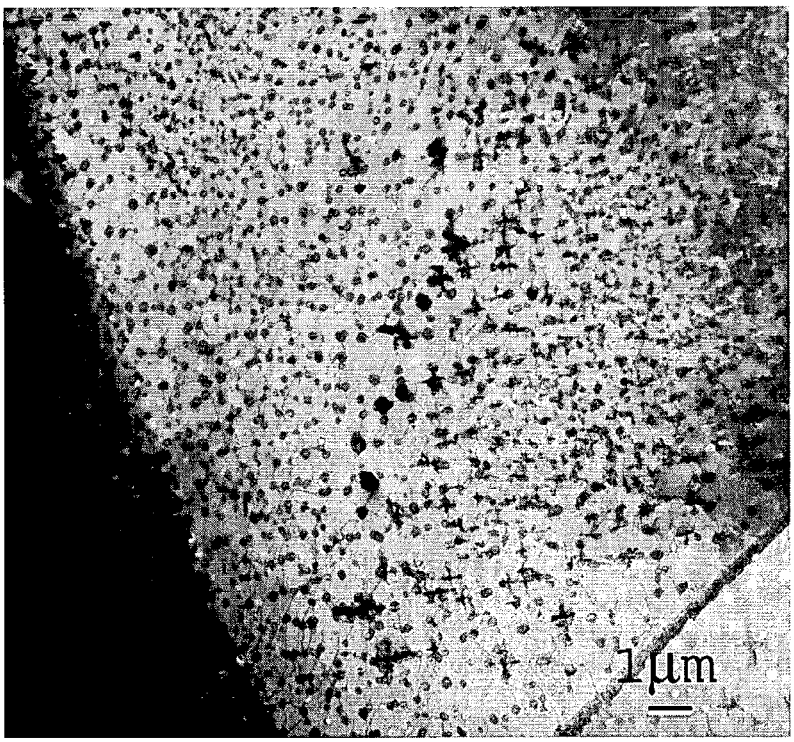
FIG. 4*b* is a photomicrograph showing the engineered microstructure of a creep test specimen of ORNL Mod 4 austenitic stainless steel in accordance with the present invention.

FIG. 4*a* shows the microstructure of a creep test specimen of 347 austenitic stainless steel, and FIG. 4*b* shows the engineered microstructure of a creep test specimen of ORNL Mod 4 austenitic stainless steel in accordance with the present invention.

Figure 5A:
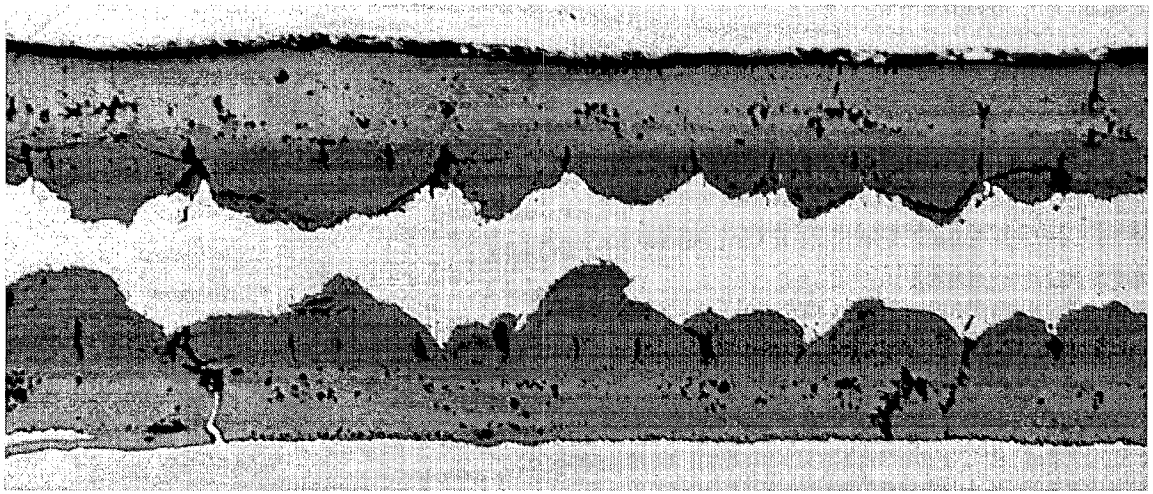
FIG. 5*a* is a photomicrograph showing the microstructure of a corrosion test specimen of 347 austenitic stainless steel.
Figure 5B:
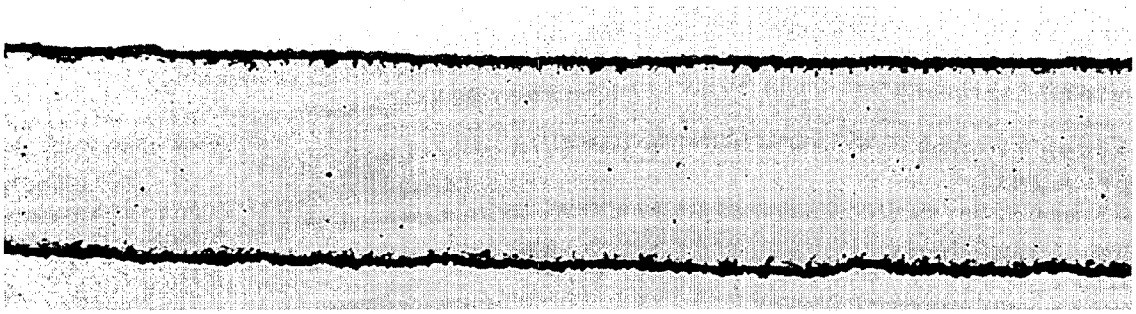
FIG. 5*b* is a photomicrograph showing the engineered microstructure of a corrosion test specimen of ORNL Mod 4 austenitic stainless steel in accordance with the present invention.

FIG. 5*a* shows the microstructure of a corrosion test specimen of 347 austenitic stainless steel, and FIG. 5*b* shows the engineered microstructure of a corrosion test specimen of ORNL Mod 4 austenitic stainless steel in accordance with the present invention.

Stainless steel alloys in accordance with the present invention may further include up to 0.3% of Hf, Zr, Ce, and/or La.

Finally, 347 steels modified in accordance with the present invention were discovered to have unexpectedly good weldability as hot-rolled and annealed plate (more difficult to weld than foils), as shown in Table 2. Conventional understanding and current art teach that such steels should be prone to weld-cracking because they do not have the 2-10% delta ferrite thought to be necessary for good weldability. These alloys can be optimized without the properties trade-offs found in related stainless steels without the combined alloying additions of the present invention.

TABLE 1

| | Alloy Compositions in Wt. % | | | | | | | | | | | | | | | | | | |
|---|---|---|---|---|---|---|---|---|---|---|---|---|---|---|---|---|---|---|---|
| Alloy/Heat | Fe | Cr | Ni | Mo | Nb | W | C | N | Si | Mn | Cu | Al | B | Ti | V | Co | Y | Hf | P |
| | Commercially Available Stainless Steels and Alloys | | | | | | | | | | | | | | | | | | |
| Std 347 | 69 | 17.6 | 0.97 | 0.34 | 0.62 | — | 0.03 | — | 0.51 | 1.53 | 0.28 | — | — | — | — | — | — | — | — |
| Std 347 HFG | 66 | 18.6 | 12.55 | — | 0.83 | — | 0.08 | — | 0.5 | 1.59 | — | — | — | — | — | — | — | — | — |
| NF709 | 51 | 20.5 | 24.9 | 1.48 | 0.26 | — | 0.067 | 0.16 | 0.41 | 1.03 | 0.05 | — | — | — | — | — | — | — | — |

TABLE 1-continued

| Alloy/Heat | Fe | Cr | Ni | Mo | Nb | W | C | N | Si | Mn | Cu | Al | B | Ti | V | Co | Y | Hf | P |
|---|---|---|---|---|---|---|---|---|---|---|---|---|---|---|---|---|---|---|---|
| | | | | | | | Alloy Compositions in Wt. % | | | | | | | | | | | | |
| Super 304H | 68 | 18.0 | 9.0 | — | 0.4 | — | 0.1 | 0.2 | 0.2 | 0.8 | 3.0 | — | — | — | — | — | — | — | — |
| 625 | 3.2 | 22.21 | 61.23 | 9.1 | 3.6 | — | 0.02 | — | 0.28 | 0.05 | — | 0.16 | — | — | — | — | — | — | — |
| | | | | | | | Examples of the Present Invention | | | | | | | | | | | | |
| 17781-1 | 66.7 | 18.9 | 11.9 | 0.3 | 0.66 | — | 0.048 | 0.011 | 0.44 | 0.9 | 0.01 | — | — | — | — | — | — | — | — |
| 17782-1 | 65.7 | 18.8 | 12.1 | 0.3 | 0.63 | — | 0.043 | 0.12 | 0.46 | 1.85 | 0.01 | — | — | — | — | — | — | — | — |
| 17783-1R | 62.9 | 18.55 | 12.1 | 0.3 | 0.67 | — | 0.058 | 0.24 | 0.43 | 4.73 | 0.01 | — | — | — | — | — | — | — | — |
| 18113(Mod 1) | 61.1 | 19.2 | 13.5 | 0.26 | 0.38 | — | 0.031 | 0.22 | 0.36 | 4.62 | 0.3 | 0.01 | — | — | — | — | — | — | — |
| 18115(Mod 2) | 58.3 | 19.3 | 12.6 | 0.25 | 0.37 | — | 0.029 | 0.25 | 0.36 | 4.55 | 4.0 | 0.01 | 0.008 | — | — | — | — | — | — |
| 18237(Mod 3) | 57.4 | 19.2 | 15.6 | 0.5 | 0.19 | — | 0.12 | 0.02 | 0.39 | 1.88 | 4.0 | 0.01 | 0.007 | 0.17 | 0.47 | — | — | — | — |
| 18116(Mod 4) | 61.1 | 19.3 | 12.5 | 0.25 | 0.38 | — | 0.03 | 0.14 | 0.38 | 1.80 | 4.0 | 0.01 | 0.007 | — | — | — | — | — | — |
| 18434-1 | 61.7 | 18.2 | 13.2 | 0.25 | 0.4 | — | 0.089 | 0.26 | 0.36 | 5.03 | 0.3 | 0.01 | — | — | — | 0.3 | — | — | — |
| 18450 | 61.8 | 18.0 | 13.1 | 0.25 | 0.38 | — | 0.037 | 0.26 | 0.4 | 5.17 | 0.3 | 0.01 | — | — | — | 0.28 | — | — | — |
| 18451 | 61.5 | 17.8 | 13.2 | 0.25 | 0.39 | 0.4 | 0.04 | 0.27 | 0.4 | 5.13 | 0.3 | 0.01 | — | — | — | 0.27 | — | — | — |
| 18528 | 55.3 | 14.8 | 15.3 | 0.31 | 0.4 | — | 0.11 | 0.05 | 0.24 | 4.98 | 4.0 | 4.23 | 0.008 | — | — | 0.3 | 0.01 | 0.05 | — |
| 18529 | 52.5 | 20.9 | 20.2 | 0.3 | 0.25 | — | 0.09 | 0.17 | 0.25 | 4.82 | 0.3 | 0.01 | — | — | — | 0.28 | — | — | — |
| 18552 | 59.7 | 17.6 | 13.1 | 0.3 | 0.38 | — | 0.092 | 0.30 | 0.34 | 3.93 | 4.0 | 0.01 | 0.008 | — | — | 0.29 | — | — | 0.02 |
| 18553 | 59.9 | 17.8 | 12.5 | 0.3 | 0.38 | — | 0.098 | 0.25 | 0.38 | 4.02 | 4.0 | 0.01 | 0.008 | — | — | 0.29 | — | — | 0.02 |
| 18554 | 60.0 | 17.5 | 13.1 | 0.3 | 0.29 | — | 0.077 | 0.29 | 0.33 | 3.87 | 3.99 | 0.01 | 0.007 | — | — | 0.29 | — | — | 0.02 |

TABLE 2

| Alloy/Heat | Plate Thickness | Penetrations | GTAW Response |
|---|---|---|---|
| | Results of Autogenous Welding Trials | | |
| Standard 347 | 0.062 in. | full | no cracking |
| Mod. 347/17781-1 | 0.25 in. | partial | no cracking |
| Mod. 347/17782-1 | 0.25 in. | partial | no cracking |
| Mod. 347/17783-1R | 0.25 in. | partial | no cracking |
| Mod. 347/18115 | 0.153 in. | partial | no cracking |
| Mod. 347/18116 | 0.148 in. | partial | no cracking |

GTAW—gas tungsten arc welding

The compositions of the present invention are most useful in thin-sheet, foil, and wire applications, preferably for articles and components having a thickness of no more than 0.020", more preferably no more than 0.010", most preferably no more than 0.005".

The invention is particularly useful in high-temperature applications requiring thin-cross-section and foil, for example, heat exchangers, fuel cells, microturbines, high-temperature ducting, hot-gas paths connecting various devices such as microturbines and fuel cells, combined heat and power applications, bellows, flexible connectors, heat shielding, corrosion shielding, various electronic applications, various automotive applications, etc.

While there has been shown and described what are at present considered the preferred embodiments of the invention, it will be obvious to those skilled in the art that various changes and modifications can be prepared therein without departing from the scope of the inventions defined by the appended claims.

What is claimed is:

1. A wrought stainless steel alloy thin sectioned article composition, comprising:

12% to 25% Cr, 8% to 25% Ni 0.05% to 1% Nb, 1.0% to 10% Mn, 0.02% to 0.15% C, 0.10% to 0.5% N, 0.25% to 1% Mo, up to 2% W, 0.24% to 1% Si, with the balance iron, Cr+Ni=41.1%, wherein the percentages are by total weight of the composition, said composition having an engineered microstructure, said engineered microstructure comprising an anstenite matrix having therein a dispersion of intragranular NbC precipitates in a concentration in the range of about $10^{14}$ to $10^{17}$ precipitates per $cm^3$, said article having a article size of 2 μm to 50 μm and a thickness of up to 15 mils.

2. A stainless steel alloy composition in accordance with claim 1 further comprising up to 5% Cu, and wherein said engineered microstructure further comprises at least one of the group consisting of intragranular copper-rich clusters and intragranular copper-rich precipitates.

3. A stainless steel alloy composition in accordance with claim 1 further comprising up to 5% Al, and wherein said composition further comprises alumina scale.

4. A stainless steel alloy composition in accordance with claim 1 further comprising up to 0.01% B.

5. A stainless steel alloy composition in accordance with claim 1 further comprising up to 1% V.

6. A stainless steel alloy composition in accordance with claim 1 further comprising up to 5% Co.

7. A stainless steel alloy composition in accordance with claim 1 further comprising up to 0.25% Y.

8. A stainless steel alloy composition in accordance with claim 1 further comprising up to 0.3% of at least one element selected from the group consisting of Hf, Zr, Ce, and La.

9. A stainless steel alloy composition in accordance with claim 1 further comprising up to 0.05% P.

10. A stainless steel alloy composition in accordance with claim 1 further comprising up to 0.1% Ta.

11. A wrought stainless steel alloy thin sectioned article composition comprising:

15% to 20% Cr, 8% to 13% Ni, 0.05% to 1% Nh, 1% to 5% Mn, 0.02% to 0.1% C, 0.10% to 0.3% N, 0.25% to 0.5% Mo, up to 2% W, 0.24% to 0.5% Si, with the balance iron, wherein the percentages are by total weight of the composition, said composition having an engineered microstructure, said engineered microstructure comprising an austenite matrix having therein a dispersion of intragranular NbC precipitates in a concentration in the range of about to $10^{14}$ to $10^{17}$ precipitates per $cm^3$ said article having a grain size of 2 μm to 50 μm and a thickness of up to 15 mils.

12. A stainless steel alloy composition in accordance with claim 11 further comprising up To 4% Cu, and wherein said engineered microstructure further comprises at least one of the group consisting of intragranular copper-rich clusters and intragranular copper-rich precipitates.

13. A stainless steel alloy composition in accordance with claim 11 further comprising up to 02% Al.

14. A stainless steel alloy composition in accordance with claim 11 further comprising up to 0.3% Ti.

15. A stainless steel alloy composition in accordance with claim 11 further comprising up to 0.01% B.

16. A stainless steel alloy composition in accordance with claim 11 further comprising up to 0.5% V.

17. A stainless steel alloy composition in accordance with claim 11 further comprising up to 1% Co.

18. A stainless steel alloy composition in accordance with claim 11 further comprising up to 0.01% Y.

19. A stainless steel alloy composition in accordance with claim 11 further comprising up to 0.3% of at least one element selected from the group consisting of Hf, Zr, Ce, and La.

20. A stainless steel alloy composition in accordance with claim 11 further comprising up to 0.04% P.

21. A stainless steel alloy composition in accordance with claim 11 further comprising up to 0.1% Ta.

22. A wrought stainless steel alloy thin sectioned article composition comprising: 15% to 20% Cr, 8% to 13% Ni, 0.05% to 1% Nb, 1% to 5% Mn, 0.02% to 0.1% C, 0.10% to 0.3% N, 0.01% to 4% Cu, 0.25% to 0.5% Mo, up to 2% W, 0.24% to 0.5% Si, with the balance iron, wherein the percentages are by total weight of the composition, said composition having an engineered microstructure, said engineered microstructure comprising an austenite matrix having therein a dispersion of intragranular NbC precipitates in a concentration in the range of about $10^{14}$ to $10^{17}$ precipitates per $cm^3$, said article having a grain size of 2 μm to 50 μm and a thickness of up to 15 mils.

23. A stainless steel alloy composition in accordance with claim 22 further comprising up to 5% Al, and wherein said composition further comprises alumina scale.

24. A stainless steel alloy composition in accordance with claim 22 further comprising up to 0.01% B.

25. A stainless steel alloy composition in accordance with claim 22 further comprising up to 0.5% V.

26. A stainless steel alloy composition in accordance with claim 22 further comprising up to 1% Co.

27. A stainless steel alloy composition in accordance with claim 22 further comprising up to 0.1% Y.

28. A stainless steel alloy composition in accordance with claim 22 further comprising up to 0.3% of at least one element selected from the group consisting of Hf, Zr, Ce, and La.

29. A stainless steel alloy composition in accordance with claim 22 further comprising up to 0.02% P.

30. A stainless steel alloy composition in accordance with claim 22 further comprising up to0:% Ta.

31. A wrought stainless steel alloy thin sectioned article composition comprising:

19% to 25% Cr, 19% to 25% Ni, 0.05% to 0.7% Nb, 1.0% to 10% Mn, 0.02% to 0.1% C, 0.10% to 0.5% N, 0.01 to 5% Al, 0.25% to 0.5% Mo, up to 2% W, 0.24% to 0.5% Si, with the balance iron, wherein the percentages are by total weight of the composition, said composition having an engineered microstructure, said engineered microstructure comprising an austenite matrix having therein a dispersion of intragranular NbC precipitates in a concentration in the range of $10^{14}$ to $10^{17}$ precipitates per $cm^3$, said composition further comprising alumina scale, said article having a grain size of 2 μm to 50 μm and a thickness of up to 15 mils.

32. A stainless steel alloy composition in accordance with claim 31 further comprising up to 4% Cu, and wherein said engineered microstructure timber comprises at least one of the group consisting of intragranular copper-rich clusters and intragranular copper-rich precipitates.

33. A stainless steel alloy composition in accordance with claim 31 further comprising up to 0.01% B.

34. A stainless steel alloy composition in accordance with claim 31 further comprising up to 0.5% V.

35. A stainless steel alloy composition in accordance with claim 31 further comprising up to 1% Co.

36. A stainless steel alloy composition in accordance with claim 31 further comprising up to 0.01% Y.

37. A stainless steel alloy composition in accordance with claim 31 further comprising up to 0.3% of at least one element selected from the group consisting of Hf, Zr, Ce, and La.

38. A stainless steel alloy composition in accordance with claim 31 further comprising up to 0.02% P.

39. A stainless steel alloy composition in accordance with claim 31 further comprising up to 0.1% Ta.

40. A stainless steel alloy composition in accordance with any one of claims 1, 2, 3, 11, 12, 22, 23, 31, or 32, wherein said steel alloy composition is formed into an article.

41. A stainless steel alloy composition in accordance with any one of claims 1, 2, 3, 11, 12, 22, 23, 31, or 32, inclusive, wherein said steel alloy composition is resistant to the formation of embrittling intermetallic phases, chromium carbides, and chromium nitrides.

42. A stainless steel alloy composition in accordance with any one of claims 1, 11, 22, or 31, inclusive, wherein the engineered microstructure is detectable after creep, high temperature exposure, or high temperature service.

43. A stainless steel alloy composition in accordance with claim 1, wherein said article provides a creep strain (%) at 750° C. and 100 MPa of <2% at 200 hours.

44. A stainless steel alloy composition in accordance with claim 1, wherein said article thickness is 5-15 mils.

45. A stainless steel alloy composition in accordance with claim 11, wherein said article thickness is 5-15 mils.

46. A stainless steel alloy composition in accordance with claim 22, wherein said article thickness is 5-15 mils.

47. A stainless steel alloy composition in accordance with claim 31, wherein said article thickness is 5-15 mils.

* * * * *